United States Patent [19]

Lasier et al.

[11] 4,040,143

[45] Aug. 9, 1977

[54] RELEASABLE DOOR HOLD-OPEN DEVICE

[75] Inventors: Thomas R. Lasier; William G. Rodseth; Raymond H. Schnarr, all of Princeton, Ill.

[73] Assignee: Schlage Lock Company, San Francisco, Calif.

[21] Appl. No.: 712,237

[22] Filed: Aug. 6, 1976

[51] Int. Cl.[2] ..... E05F 15/20

[52] U.S. Cl. ..... 16/48 J; 49/31; 49/279; 49/379; 292/273; 340/237 S

[58] Field of Search ..... 49/31, 279, 379; 16/48 J; 340/237 S; 292/273

[56] References Cited

U.S. PATENT DOCUMENTS

| | | | |
|---|---|---|---|
| 2,887,194 | 5/1959 | Noltin et al. | 292/273 |
| 3,164,404 | 1/1965 | Arnold | 292/273 |
| 3,415,562 | 12/1968 | Petersen | 16/48 J X |
| 3,648,326 | 3/1972 | Gayowski | 16/48 J |
| 3,729,770 | 5/1973 | Lasier | 16/48 J |
| 3,729,771 | 5/1973 | Crane et al. | 49/31 X |
| 3,771,823 | 11/1973 | Schnarr | 16/49 X |
| 3,777,423 | 12/1973 | Coulter et al. | 16/48 J X |
| 3,905,063 | 9/1975 | Coulter et al. | 16/48 J |
| 3,908,309 | 9/1975 | Coulter et al. | 49/31 |
| 3,964,125 | 6/1976 | Tansley | 16/48 J |

FOREIGN PATENT DOCUMENTS

| | | | |
|---|---|---|---|
| 2,128,925 | 6/1971 | Germany | 16/48 J |

*Primary Examiner*—Werner H. Schroeder
*Assistant Examiner*—Conrad L. Berman
*Attorney, Agent, or Firm*—Lothrop & West

[57] ABSTRACT

A releasable door hold-open device or assembly is mounted on the header over a door panel. The assembly has a track channel with a top web and depending flanges. A door panel connector arm has a traveller movable in the track channel. A solenoid operates a detent in the track channel near the hinge end of the traveller path. A conductor channel is fastened to the top web and communicates with the track channel through an opening. A connector block releasably adjoins the track channel and the conductor channel at the hinge end thereof. A smoke detector underlies the connector channel at the other end of the track channel. Conductors from outside extend through the connector block, through connecting plugs in the block and track channel and to the solenoid and through the conductor channel to the smoke detector.

7 Claims, 8 Drawing Figures

FIG-1
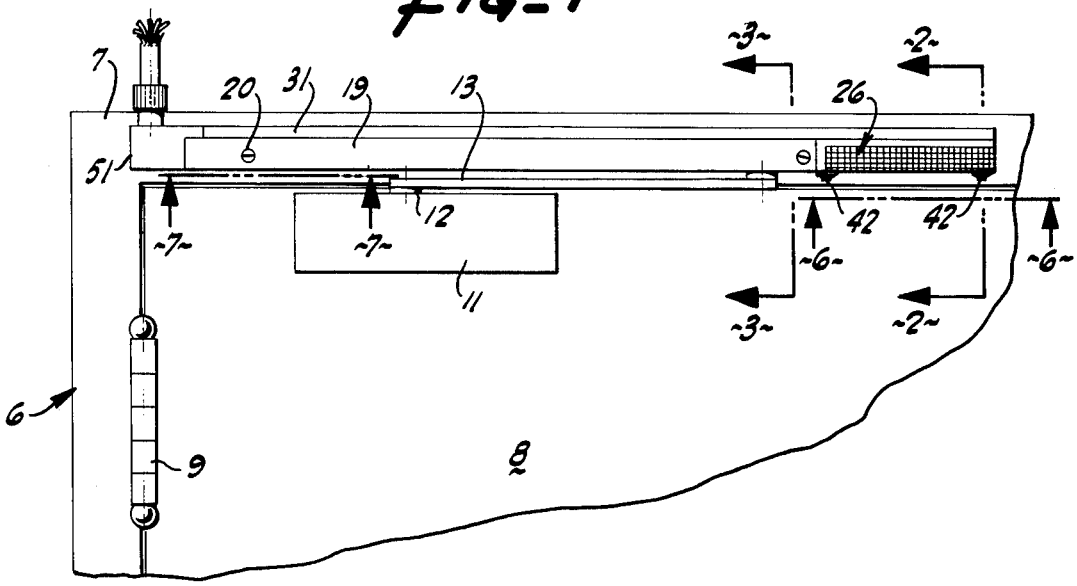
FIG-3
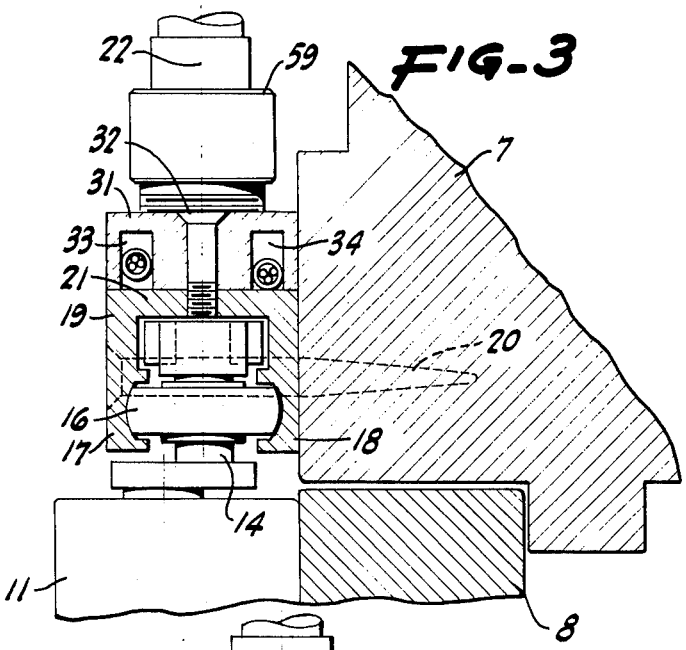
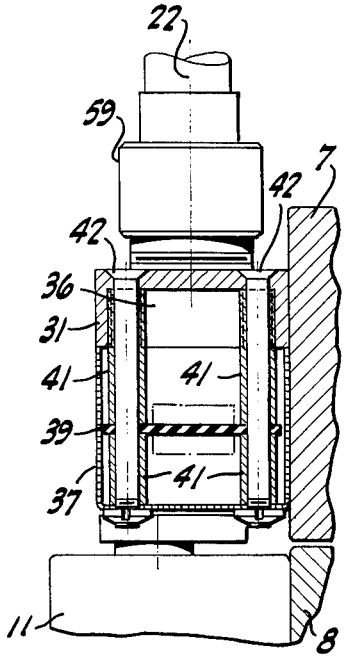
FIG-2
FIG-8
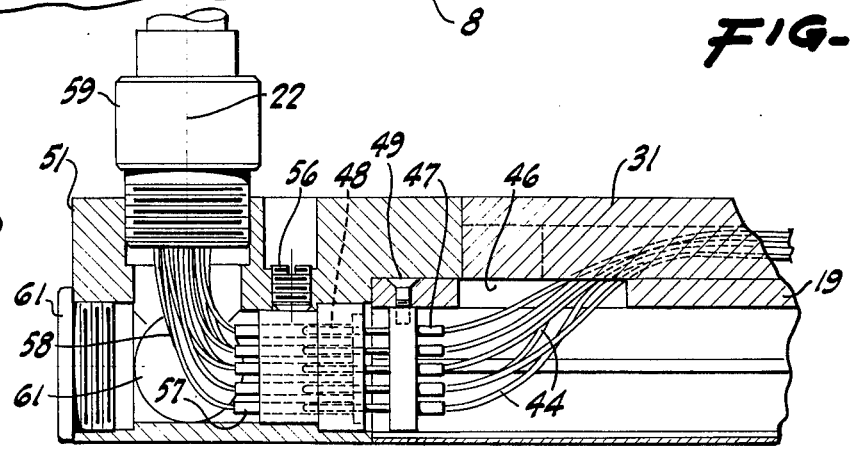

RELEASABLE DOOR HOLD-OPEN DEVICE

BRIEF SUMMARY OF THE INVENTION

A structure for a releasably controlled door hold-open mechanism is especially for use in connection with the frame and panel for a hinged door and is for use with a door closer having a hold-open feature. The mounting includes a track channel that is easily fixed to the door header with the channel web at the top and the channel flanges depending at the sides. A conductor channel overlies that track channel with an overhang opposite the hinge end. A traveller connected to the door panel moves in the track channel beneath the web. In the track channel near the hinge end is a solenoid operating a hold-open detent effective releasably to secure the traveller against movement. Beneath the overhang is a smoke detector open to the atmosphere at one end and on the sides and bottom. A connector box at the hinge end of the channels detachably engages one of them. Conductors from the connector box go through plug connectors into the track channel and through an opening into the conductor channel to interconnect with the solenoid and the smoke detector.

Door closers having hold-open features are well known; for example, see Schnarr, U.S. Pat. No. 3,771,823 of Nov. 13, 1973. It is advisable under some circumstances to have an automatic release of the hold-open mechanism particularly in the case of fire. While fusible links have been used, it is presently popular to utilize a smoke detector as a means responsive to fire or related dangerous conditions. A mechanism of this sort is shown in Coulter, U.S. Pat. No. 3,777,423 of Dec. 11, 1973, the closest prior art known to the applicants. Largely because of the critical nature of some of the mechanism and its operation, it is important to provide a well-integrated, protected and carefully interrelated device. Earlier mechanisms have included many different parts that could become displaced or disconnected without warning. Some early devices require a good deal of labor for installation and require later inspection and adjustment to maintain their capacity for the desired duty. Some such devices are not well adapted for mounting on either side of a door frame, even to the extent that the intended function of the device is impaired if the mounting is or becomes faulty. It is also beneficial to have the complexity, weight and bulk of the mechanism largely reduced from those heretofore known in order to ensure safe, long life and satisfactory operation as well as relatively inexpensive manufacture, simple installation and reliable servicing.

BRIEF DESCRIPTION OF THE SEVERAL VIEWS OF THE DRAWING

FIG. 1 is an elevation, portions being broken away, of a typical device pursuant to the invention mounted in connection with a door frame and panel, the parts being in door closed position.

FIG. 2 is a cross-section to an enlarged scale, the plane of section being indicated by the line 2—2 of FIG. 1.

FIG. 3 is a cross-section to the scale of FIG. 2, the plane of section being indicated by the line 3—3 of FIG. 1.

FIG. 8 is a cross-section on a vertical, central plane through the hinge end of the device.

DETAILED DESCRIPTION

Figure 4:
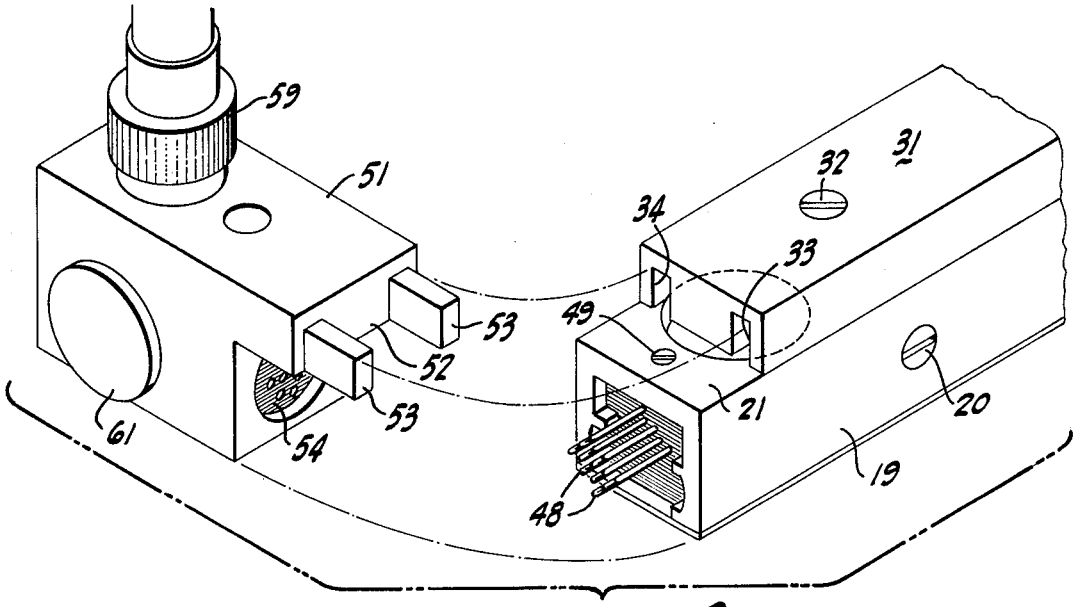
FIG. 4 is an exploded view, parts being broken away, of the hinge end of the device.
Figure 5:
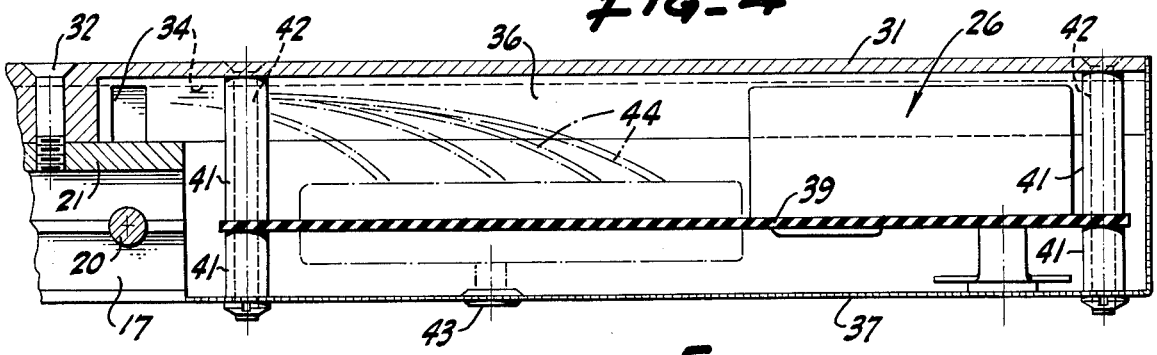
FIG. 5 is a cross-section of the end of the device away from the hinge, the plane of section being indicated by the line 5—5 of FIG. 6.
Figure 6:
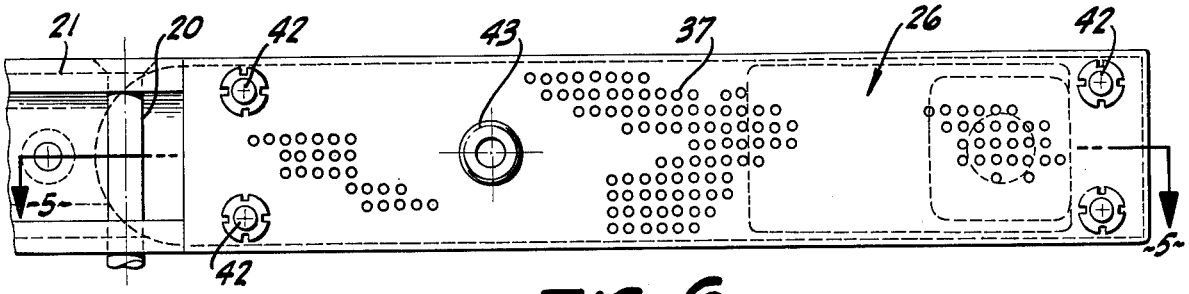
FIG. 6 is a bottom plan view of the structure of FIG. 5.
Figure 7:
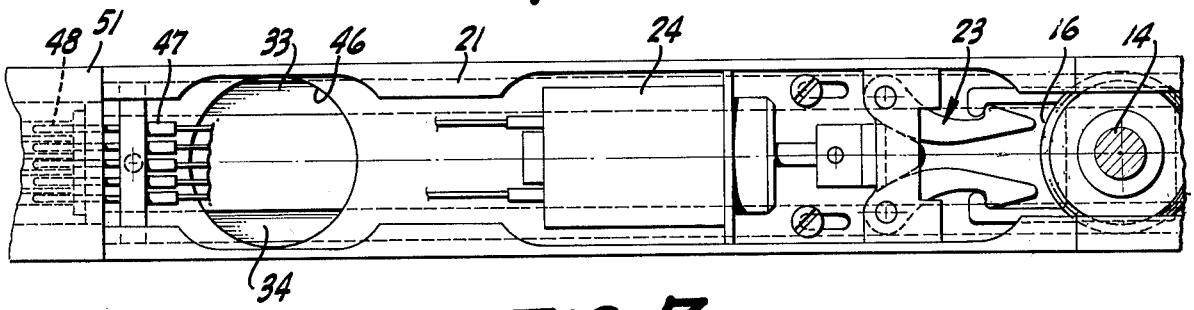
FIG. 7 is a bottom plan view of the device near the hinge end, the view being as indicated by the line 7—7 of FIG. 1.

In a typical installation the releasable door hold-open device is designed to be mounted on a door frame 6 especially on the header 7 thereof. A door panel 8 is connected to the frame 6 by the customary mounting hinge 9. Secured to the door panel is a door closer 11 or closer and check unit of any standard sort. This unit normally includes a spring effective to urge the door panel into a closed position and may also include a hydraulic or comparable damper or regulating mechanism to govern the rate or rates of closure of the panel 8 with respect to the frame 6. The unit 11 has an extended operating shaft 12 to which one end of a connector arm 13 is secured. In turn, the connector arm has a pin 14 remote form the shaft 12 and carrying a traveller 16, as shown in U.S. Pat. No. 3,771,823, above noted.

The traveller is preferably a wheel or block having curved or circular-cylindrical sides received in the correspondingly shaped portions of depending side flanges 17 and 18. The flanges are integral portions of an elongated channel 19 having a top, horizontal web 21, the channel being secured to the door header 7 by any suitable means such as screws 20. Much of the mechanism is substantially symmetrical about a central, vertical plane 22 so that, depending upon the environment, either the flange 17 or the flange 18 can be disposed against the door header 7.

The traveller 16 is adapted to move in a predetermined, linear path between but short of the ends of the channel 19. Toward one end, the hinge end of the channel, the slider can be interengaged with a hold-open structure, generally designated 23, of the sort shown in the above-noted Schnarr patent. The hold-open device, when energized, is effective to seize the traveller 16 when the traveller is in its extreme position closest to the hinge. The hold-open maintains such seizure as long as a controlling solenoid 24 mounted on the channel 19 is electrically energized. When the solenoid is de-energized, then the seizing or detent mechanism is released and the standard spring mechanism (not shown) in the closer unit 11 is effective through the arm 13 and the traveller 16 to move the door panel 8 into its closed position. During such closure, the traveller returns in its predetermined path toward the other end of the channel 19.

Particularly pursuant to the present arrangement, an ambient condition detector 26, such as a smoke detector, is coordinated with the channel 19. The detector is of any suitable sort and preferably is effective, upon the presence of smoke particles in the immediate vicinity of the detector, to change the condition of an electrical circuit including the solenoid 24 by operating an internal switch (not shown). The usual condition is for the detector to maintain the electrical circuit by keeping the internal detector switch closed and then, when smoke particles are detected by the detector, to open the circuit by opening the internal detector switch.

In order to mount the dectector in a position just above and approximately centrally of the door opening, a presently favored location, the channel 19 has its central, top web 21 and the side flanges 17 and 18 adjacent the end remote from the hinge cut away or otherwise omitted. Superposed on the channel 19 in abutment with the top web 21 thereof is a conductor channel 31. This, like the channel 19, is preferably an elongated extrusion stopping slightly short of the hinge end of the channel 19 but extending well past the opposite end thereof. The conductor channel 31 is removably secured to the channel 19 by screws 32. Formed in the conductor channel are longitudinal open-bottom grooves 33 and 34 of rectangular cross-section, closed by the subjacent web 21 and opening into an end chamber 36.

In effect, continuing the channel 19 is a protecting screen 37 disposed at the end thereof and forming a perforated case semi-closed on both sides, the bottom and the far end. The screen is about the same cross-sectional contour as the channel 19 and is about as long as the overhang of the conductor channel 31. Within the screen 37 is the detector 26 and an associated circuit board 39, the parts being supported on posts 41 and by fasteners 42, one or more access grommets 43 being provided for adjusting devices. Since the board 39 is spaced from the screen, electronic components are mounted on both sides of the board for compactness, accessibility and heat dissipation to the adjacent metal.

Conductors 44 extend from the board 39 into the end chamber 36 and then into and through the grooves 33 and 34, being well protected by the channel 31. Near the hinge end of the channel 19, the conductors 44 emerge from the grooves 33 and 34 and pass through an opening 46 in the web 21 and into the end of the channel 19. All these conductors, plus conductors for the solenoid 24, if desired, join respective terminal sleeves 47 forming part of a male connector plug 48 secured in place by a screw 49 but bodily movable, when the screw is withdrawn, through the opening 46. In this way, a sub-assembly is made so that the conductor channel and the smoke detector can be removed from or combined as a unit with the channel 19.

To complete the circuitry, a connector 51 in the form of a block is mounted at the hinge end of the device. The block has an overhanging lip 52 from which extend rectangular prongs 53 tightly engageable with the walls of the conductor channel forming the grooves 33 and 34, the lip closely overlying the web of the channel 19. A female plug 54 is removably held in an opening in the block by a countersunk fastener 56, the plug 54 having female conector sleeves 57 joined to conductors 58 extending through the block into and through a conduit fitting 59 thereon, from which the conductors go into standard circuitry, not shown. End and side plugs 61 allow positioning and withdrawal of the female plug 54.

With this arrangement, a relatively standard electrically actuated hold-open, door closer and check device can readily be supplemented by a smoke detector unit and electrical connections. The assembly is easily made and disassembled, the unit is substantially strengthened and protected, the conductors are guarded and well positioned, and the smoke detector itself is afforded a mounting in a desired location, well protected especially from above against mechanical injury yet well exposed on the bottom, sides and end to ambient atmosphere.

We claim:

1. A releasable door hold-open device comprising an elongated channel defining an internal guide, a door connector, a traveller on said door connector adapted to travel in a predetermined path in said guide, holding means on said channel movable between a first position in engagement with said traveller and a second position out of engagement with said traveller, a solenoid adapted when energized to hold said holding means in said first position, means for mounting said solenoid at one end of said elongated channel, an electric smoke detector, means for mounting said detector at the other end of said elongated channel, at least one electrical conductor connected to said detector and to said solenoid, and means for disposing said conductor along said channel at one side of but out of said path.

2. A device as in claim 1 in which said disposing means is a conductor channel removably secured to said elongated channel.

3. A device as in claim 2 in which said conductor channel has an overhang at said other end of said elongated channel, and said detector mounting means engages said overhang of said conductor channel.

4. A device as in claim 3 including a protecting screen disposed partially around said detector, said screen substantially continuing said elongated channel at said other end thereof and terminating substantially at said other end of said conductor channel.

5. A device as in claim 4 including a circuit board for said detector, and in which said detector mounting means suspends said circuit board and said screen from said conductor channel.

6. A device as in claim 2 in which said conductor channel stops short of said one end of said elongated channel, and a connector block at said end of said elongated channel engages said conductor channel.

7. A device as in claim 6 in which said conductor channel has walls defining a pair of grooves open at said end, and said conector block has a pair of prongs engageable with said groove walls.

* * * * *